United States Patent [19]

Birnbach et al.

[11] Patent Number: 4,670,894

[45] Date of Patent: Jun. 2, 1987

[54] X-RAY SOURCE EMPLOYING COLD CATHODE GAS DISCHARGE TUBE WITH COLLIMATED BEAM

[75] Inventors: Curtis Birnbach, Bronx; Jay Tanner, Nesconset, both of N.Y.

[73] Assignee: Quantum Diagnostics Ltd., Hauppauge, N.Y.

[21] Appl. No.: 736,136

[22] Filed: May 20, 1985

[51] Int. Cl.[4] ..... H01J 35/30; G21K 1/02

[52] U.S. Cl. ..... 378/122; 378/136; 378/147

[58] Field of Search ..... 378/122, 136, 157, 147, 378/193, 208; 313/336; 250/515.1

[56] References Cited

U.S. PATENT DOCUMENTS

| | | | |
|---|---|---|---|
| 3,229,089 | 1/1966 | Sasao | 378/157 |
| 3,567,940 | 3/1971 | Lambert | 378/106 |
| 3,840,748 | 10/1974 | Braunlich | 378/122 |
| 3,883,760 | 3/1975 | Cunningham, Jr. | 378/136 |
| 4,289,969 | 9/1981 | Cooperstein et al. | 378/122 |

FOREIGN PATENT DOCUMENTS

| | | | |
|---|---|---|---|
| 0101043 | 2/1984 | European Pat. Off. . | |
| 0746771 | 7/1980 | U.S.S.R. | 378/122 |

*Primary Examiner*—Janice A. Howell

*Attorney, Agent, or Firm*—Ostrolenk, Faber, Gerb & Soffen

[57] ABSTRACT

An X-ray tube has a wide area cold cathode with a graphite felt surface which faces and is spaced from a wide area anode of high atomic number material. A grid is interposed between the two and the anode, grid and cathode are enclosed in an envelope which is filled with gas at a low pressure. The graphite surface of the cathode is connected to a relatively high negative potential so that electrons are emitted from the entire surface area and impinge upon the anode, after triggering by the grid. The distribution of the energy of photons emitted from the anode is relatively constant during the ignition period of the tube. An extremely wide area X-ray source is then defined having constant bremstrahlung content which enables good gray scale measurements when employing the X-ray source. A pinhole collimator disposed externally of the tube ensures collimation of the output X-ray field. A polarized electron beam is used as a collimator in place of the pinhole collimator, in a preferred embodiment, to produce a collimated, wide area X-ray flux. The cathode, grid and anode structure can have any desired size or shape. The X-ray source can be flat and sized to illuminate a chest X-ray film or can be arcuate to at least partly wrap around the subject to be exposed to the X-rays. Arcuate X-ray sources can be linked end to end and scanned sequentially to define an X-ray source for use in Computer Axial Tomography (CAT) scan type applications. The same computer algorithm used for conventional CAT scan analysis can be used.

18 Claims, 17 Drawing Figures

X-RAY SOURCE EMPLOYING COLD CATHODE GAS DISCHARGE TUBE WITH COLLIMATED BEAM

BACKGROUND OF THE INVENTION

This invention relates to an X-ray source and more particularly relates to a novel wide area X-ray source.

X-ray source tubes are well known and commonly employ a tube having a cathode heated by a filament which produces an electron beam which is focused on a small area target region on an anode. X-rays are then generated at that small target region and the X-ray beam is then directed toward the region of application. Since the focused electron beam at the anode causes extreme heating, the anode is commonly rotated so that the X-ray emission region of the anode is constantly moved, thereby preventing localized overheating of the anode surface.

X-ray tubes of the above noted type have numerous failure modes. These include: burning out of the electron filament source; anode heating and pitting of the anode or target by the highly concentrated X-ray beam; plating of the anode material on the interior walls of the tube; and failure of the bearings in the high speed rotor. Moreover, the source of X-rays is essentially a poor point source since the heated target region on the anode which emits X-rays is rarely smaller than one millimeter square. In its design, a trade off is made between focal spot size, spatial resolution and ample heat capacity.

The use of a cold cathode rather than a filament heated cathode avoids the problems stated above for prior art X-ray tubes. Thus, the use of a cold cathode avoids the need for a heated filament and the cold cathode can form a relatively wide surface area source of energetic electrons. Thus, a high density spot on the anode is also avoided.

A cold cathode diode used as an X-ray source is known for use as a source of preionization energy for a discharge-excited laser in which a broad area, collimated X-ray flux pre-excites the gas of a laser tube. A device of this type is sold by Helionetics, Inc., under the name HXP-Series X-Ray Preionizer. A cold cathode diode tube X-ray source is also disclosed in European patent application publication No. 0101043, filed Aug. 8, 1983, by Helionetics, Inc. of Irvine, Calif.

Use of a cold cathode tube X-ray source in diode form, as disclosed in the above European patent application and used in the HXP-Series X-Ray Preionizer produces X-rays with a variable energy spectrum during the operation of the tube. Thus, the bremstrahlung of a given tube is related to its peak operating voltage (KVpeak). In a cold cathode tube it is known that the tube strikes at a relatively high peak voltage, and, but after the tube begins to conduct, the KVpeak reduces to a relatively low value and varies with tube current. Consequently, the bremstrahlung or spectra of the emitted X-rays changes during the tube operation. A constant bremstrahlung content, however, is necessary to obtain proper gray scale rendition when the tube is used, for example, for medical diagnostic purposes. Note that this is not significant when the output X-ray beam is used for preionization of a laser gas. However, the X-ray output of the cold cathode diode of the above European patent application cannot be used for diagnostic purpose or other purposes requiring a constant spectral distribution in the output X-ray beam.

Note that in the heated filament X-ray tube of the prior art, there is only a single KVpeak which is employed in the tube operation (unlike a cold cathode tube) so that the X-rays produced in such a tube have the requisite constant spectral distribution during the tube operation. Moreover, great pains are taken on the control systems of such tubes to insure a constant KVpeak. With a cold cathode tube, however, if the tube fires at 150 KV, it may drop to 100 KV or less during operation. The tube will conduct for only up to a maximum of about 1 microsecond but the bremstrahlung content at the 150 KV level will be present for an appreciable portion of the entire pulse period thus drastically effecting the spectral distribution of the beam during its duration. After this tube is in arc conduction, the tube voltage varies with arc current, causing further change in the bremstrahlung spectrum. For the above reasons, it has not been possible to apply cold cathode diode type tubes to the production of X-rays for diagnostic purposes or other purposes requiring a constant bremstrahlung spectrum.

BRIEF DESCRIPTION OF THE INVENTION

In accordance with the invention, a novel cold cathode tube is employed in which a constant bremstrahlung spectrum is obtained. Thus, a control grid is disposed between cathode and anode. The control grid ensures the firing and operation of the tube at substantially a constant voltage thus avoiding a change in KVpeak for the tube and the consequent shift in bremstrahlung content.

The cold cathode gas tube of the invention can employ as many grids as desired in accordance with known multi-grid construction for cold cathode tubes and hydrogen thyratrons. Moreover, the tube can have any desired geometry so that, for example, the tube may be flat, or formed of arcuate sections which can wrap around a patient, defining sources for use in a Computer Axial Tomography (CAT) scan system. This CAT scan system employs computerized reconstruction of the data which is produced by detectors which face the arcuate segments of the X-ray tubes, using known algorithms for existing CAT scan devices, primarily the RADON transform.

In accordance with the present invention, it is also possible to construct the tube in such a manner that the anode can be changed without replacing the entire tube. Thus, the atomic number (Z) of the material which is used for anodes of X-ray sources determines the basic spectral distribution of the output X-rays. In different diagnostic applications of an X-ray tube, different spectral distributions may be desired. The present invention permits rapid insertion of new anodes in the tube. Thus, anode sections on a pivoted plate can be rotated into position above a fixed cathode and grid, with the entire mechanism contained within the main sealed envelope to obtain desired radiation patterns.

While the tube can be constructed of any desired materials, a preferred cathode consists of a graphite felt of known construction which is cemented to a graphite substrate via a suitable graphite adhesive. The felt type surface of the cathode has, in effect, a large number of sharp discrete graphite fibers at the cathode surface, which produce small plasmas when exposed to a sufficiently high electric field. Thin closely packed metal blades could also be used for the cathode surface.

A suitable anode, for example of tungsten, which is coextensive with the cathode but is spaced therefrom, for example by a constant dimension, is also provided. Preferably the anode is formed of a uniform thin film of high Z material, such as tungsten, which is deposited on an optically flat and smooth substrate. A grid which may be a pure nickel screen is interposed between the anode and cathode and is coextensive with their facing areas.

The electrodes are then supported within a suitable evacuated vessel which is filled with a gas such as hydrogen or argon at relatively low pressure, for example $10^{-4}$ torr. Other pressures can be used. The interior of the vessel can be connected to a constantly operating vacuum pump with a source of hydrogen or other gas contained within the tube to constantly replenish gas which may be removed.

A source of negative voltage is then applied to the cathode and a source of control voltage is connected to the grid. The voltages applied between cathode, grid and anode are arranged so that the grid electrostatically shields the cathode from the anode to prevent anode to cathode breakdown when the anode to cathode potential exceeds breakdown voltage. Breakdown can then occur only when the grid to cathode potential is large enough to allow gas ions to initiate secondary electron emission from the cathode (or when the grid to cathode breakdown potential is reached). When ignition does take place between the cathode and grid, the major portion of the electron current immediately shifts from the grid to the anode if the anode is at sufficiently high potential with respect to the grid. Appropriate resistances are placed in the grid and cathode leads to limit current flow to these electrodes. The anode is at ground potential. Once ignition takes place, the grid no longer has any control over the system. Thus, the tube sees only a single KVpeak so that the bremstrahlung spectrum is constant over the duration of the current pulse which can last, for example, up to 1 microsecond. This produces an X-ray flux over the full area of the anode which exits the vessel through an appropriate window during the pulse period. This flux is relatively well collimated over a wide area which could, for example, be 16 inches×16 inches for chest X-ray application or any other area which is desired for the diagnostic or other application.

To ensure collimation, a pinhole lead collimator could be used. A pinhole collimator will, however, produce some scatter. In a preferred embodiment, the electron beam is polarized so that it inherently serves as a collimator by forcing the electrons to impinge on the target at a constant and known angle, thus producing a collimated X-ray flux. That is, if the electron flux is polarized and all electrons reach the target at the same angle, the X-rays will be produced as a collimated flux. Such polarization can be obtained by applying appropriate magnetic or electrostatic fields to the electron beam.

An important application of the X-ray tube of the present invention is in medical diagnostics. However, the tube can be advantageously applied to other applications requiring a constant bremstrahlung spectrum.

In accordance with another aspect of the present invention, a novel system is disclosed, in which a large area X-ray tube having a generally collimated X-ray flux or output is used in an X-ray microlithography application. Thus, at the present time, in order to reduce spacing of lines on a semiconductor wafer or chip surface, the semiconductor industry has turned to the use of X-ray microlithography rather than ultraviolet light lithography. The X-ray sources for such photolithography conventionally employ very highly forcused electron spots on a target anode, which then produces a conically shaped X-ray flux output. Such tubes have the disadvantages previously referred to for conventional heated cathode X-ray tubes and the sharp focus needed to obtain the effect of a point source only aggravates those problems.

The use of a wide area cold cathode tube, either with or without grid, has very beneficial application to X-ray microlithography work since the tubes are long lived and provide the inherently desirable collimated X-ray flux which will produce extremely fine line patterns without complicated collimation procedures. It is also known to employ the X-ray output from a synchrotron for use in X-ray microlithography work, buy the use of such synchrotrons is, of course, limited by their expense, large size and inefficiency.

BRIEF DESCRIPTION OF THE DRAWINGS

FIG. 7 is a side elevation view of a tube which can have an arcuate form along its length, wherein FIG. 1 is a cross-section of FIG. 5 taken across the section line 1—1 in FIG. 5.

DETAILED DESCRIPTION OF THE INVENTION

Figure 1:
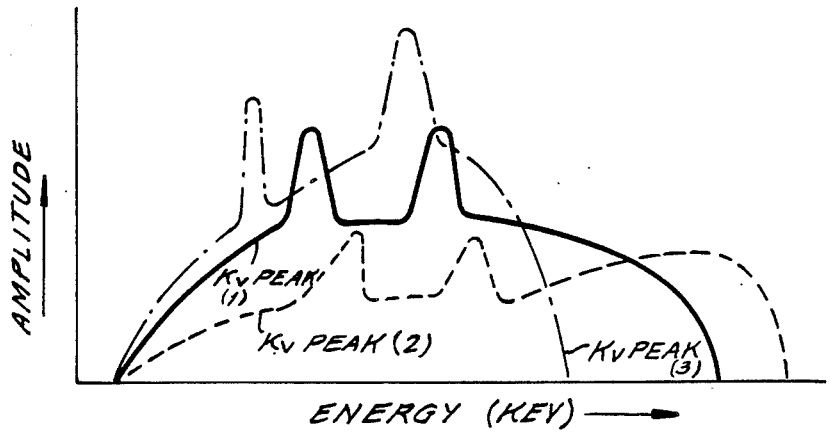
FIG. 1 shows the bremstrahlung content for cold cathode tubes at different values of KVpeak.
Figure 2:
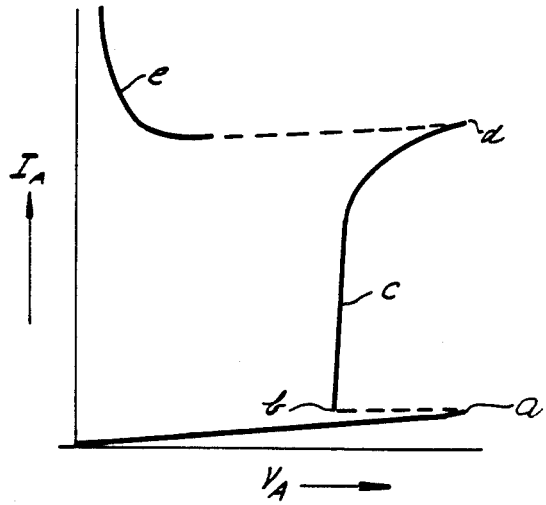
FIG. 2 shows the current voltage characteristcs of a cold cathode diode in which KVpeak varies during the operation of the tube.

Referring first to FIGS. 1 and 2, there is disclosed the bremstrahlung at different KVpeaks for a gas diode tube and the current-voltage characteristics of the tube, respectively. As shown in FIG. 1, the energy spectrum of X-rays which are produced in a cold cathode diode, depend strongly on the peak voltage KVpeak applied between the anode and cathode. Three bremstrahlung curves are shown for KVpeak 1, KVpeak 2 and KVpeak 3, respectively, shown in solid, dotted, and dash-dot lines. As pointed out previously, with changes in bremstrahlung as shown at the different KVpeaks, the X-ray distribution which is produced during the pulse interval will vary in a cold cathode tube since the KVpeak of a cold cathode tube varies during its operation.

Thus, as shown in FIG. 2, the traditional current voltage characteristic of a cold cathode gas diode is shown. In the conventional cold cathode gas diode, a gas pressure of from 0.001 to 0.01 millimeters of mercury is used in an envelope containing an anode and cathode. As the anode potential $V_A$ is made progressively more positive with respect to the cathode, the tube current $I_A$ in FIG. 2 increases slowly from an initial value of about 1 microampere until point a of FIG. 2 is reached. This initial current is known as the "dark current" because, under these conditions, there is no visible glow in the gas. When the ignition or breakdown potential corresponding to point a is reached, the ionized gas within the tube conducts heavily and the potential between anode and cathode drops abrubtly to a value determined by the type of gas in the tube and the cathode material. From the point b to the point c, the tube current ($I_A$) remains very nearly constant as the tube potential ($V_A$) is increased. This is called the "glow discharge region" because a portion of the tube becomes luminous and it represents the normal operating voltage of the conventional cold cathode gas diode used as a voltage regulator. The maximum tube current in this region is determined by the cathode area.

At point c, the tube current increases with an increase in applied voltage $V_A$ until the point d is reached. This is known as the "abnormal glow region". At some current, such as that at the point d, the cathode surface becomes hot enough, because of ion bombardment, to emit electrons and the abnormal glow discharge changes to an arc discharge. The arc discharge is a declining voltage, high current discharge and the tube voltage drops abuptly to the point e. Beyond this point e, a larger tube current results in a slow decrease in tube voltage. It is in this region e that high velocity electrons will be accelerated toward the anode to produce output X-rays when using an appropriate target for the anode.

In the operation of the cold cathode diode for an X-ray source, therefore, a varying KVpeak will be produced, one at point b changing to another at e, which tends to vary depending on tube current. Since the tube KVpeak varies substantially, the bremstrahlung spectrum over the pulse period, which may be as long as up to 1 microsecond, will also vary. As pointed out previously, this change in bremstrahlung content prevents proper gray scale rendition with the output X-ray beam.

In accordance with one feature of the present invention, a novel cold cathode tube is provided which has at least one grid and may have other grids if desired. The use of a main control grid, ensures the firing of the tube at a single potential and its operation at this same potential. Consequently, the output bremstrahlung content for the tube is relatively constant over its entire pulse or continuous operation range.

Figure 3:
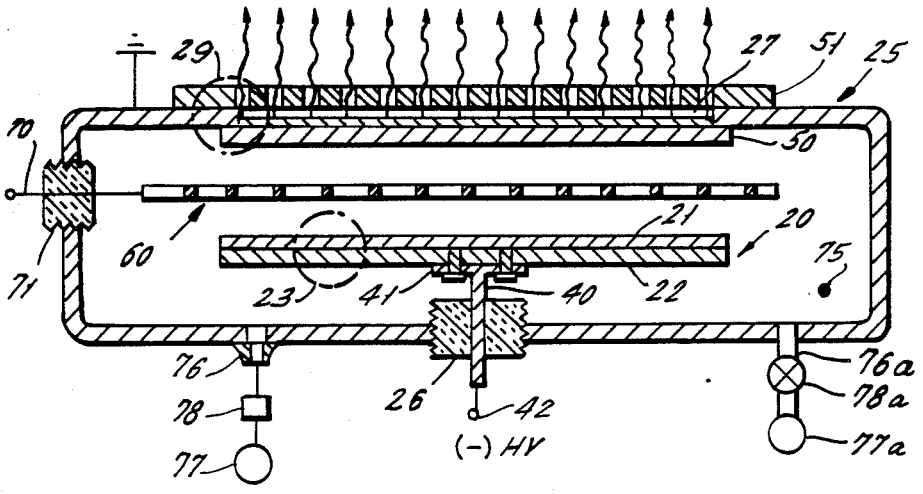
FIG. 3 is a cross-sectional view of the novel X-ray tube of the invention, which is a cold cathode triode type tube.
Figure 7:
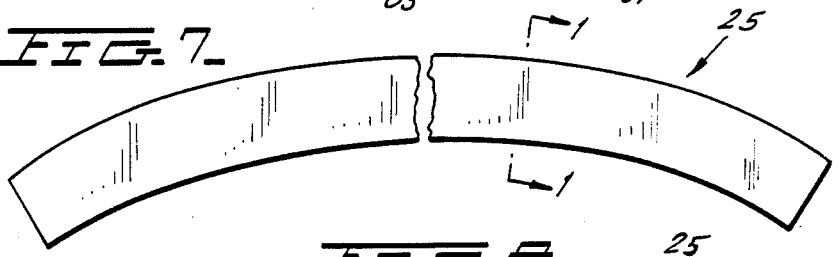
Figure 8:
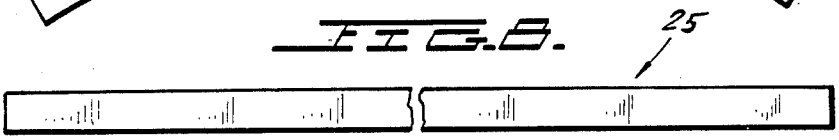
FIG. 8 is a top view of FIG. 5.

FIG. 3 shows the novel tube of the invention in cross-section. The tube can be elongated perpendicularly to the plane of the figure to any desired length or geometry. Thus, the tube can be an elongated rectangle or circular or square or it can be arcuate, as shown in FIGS. 7 and 8 which will be later described.

Referring to FIG. 3, the novel tube of the invention contains a cathode 20 which has a construction which encourages emission of electrons over its full surface which, as stated above, could be 14 inches × 18 inches if the tube is to be used for chest X-ray purposes. Cathode 20 can consist of a graphite felt portion 21 and pure graphite substrate 22 as better shown in the enlarged area of FIG. 4 which is an enlargement of the circled area 23 of FIG. 3. The pure graphite substrate 22 can have a thickness of from ¼ inch to ½ inch, although this is not a critical dimension. It need only be thick enough to be mechanically rigid. Graphite felt layer 21 also has a non-critical thickness, for example ¼ inch to ½ inch, and presents a felt like surface which encourages ionization and electron emission when the surface is placed in a relatively high electric field. The graphite felt has the consistency of flexible polyurethane sheet and has little mechanical strength and must be supported by substrate 22. Such graphite and graphite felt materials are commercially available. For example, the felt can be obtained from the Union Carbide Company under their name "W.D.F.", catalog No. X-3100. The graphite plate is widely available. Note also that graphite anodes are well known for use in electron tubes and that tube technology can be employed in making the cathode of the tube of the present invention. The entire outer periphery of the cathode 20 is preferably rounded to avoid sharp surfaces to which a localized arc discharge might preferably attach. Note that for rounding the outer periphery of cathode 20, it is possible to wrap the felt layer 21 around the outer periphery of the substrate 22.

Figure 4:
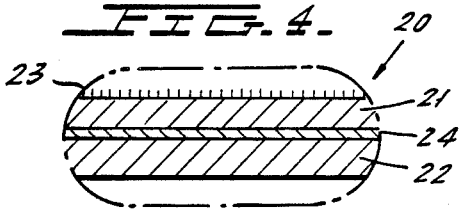
FIG. 4 is an enlarged view of the structure of the cathode of FIG. 1.

Layers 21 and 22 are secured together in any desired manner, for example through the use of a graphite adhesive, having a thickness, for example of about 1 mil. Such graphite adhesives, which are colloidal suspensions, are known and are commercially available, for example from the Dylon Industries of Berea, Ohio, as their GC grade adhesive. The laminates 21 and 22 with the adhesive 24 between them, as shown in FIG. 4, may be secured together by firing in a known process by ramping the temperature in a controlled manner in a furnace to about 2,000° F. in a nitrogen atmosphere. This firing process removes impurities from the plate and felt and sets the glue 24.

The cathode 20 is appropriately supported within a low pressure, gas-filled envelope 25. For example, envelope 25 can consist of a stainless steel enclosure which has a suitable X-ray window which can be made of thin aluminum 27 as will be later described. The enclosure 25 can be of a stainless steel type 316 and encloses the entire tube except for the X-ray window 27. Glass or quartz could be used for the entire envelope 25 and would inherently define the X-ray window. However, the use of steel makes the tube more easily repairable.

Figure 5:
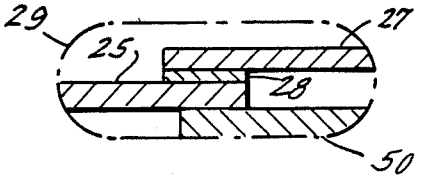
FIG. 5 is an enlarged view of the connection between the X-ray window of the tube of FIG. 1 and the main body of the envelope.

When using an aluminum window 27, the window 27 can be secured to the stainless steel case 25 by a thin indium layer 28, as shown in FIG. 5 which shows the circular area 29 of FIG. 3 in more detail. The aluminum window can have a thickness of about 2 millimeters and the steel casing 25 can have a thickness of about 3/16 inch.

Cathode 20 is supported relative to casing 25 by means of an elongated OFHC copper rod 40 which may have a flange surface 41 which is bolted to the cathode substrate 22 as schematically illustrated. THe copper rod 40 extends through and is a part of the ceramic feed-through member 26 which is suitable secured within casing 25 and provides a terminal 42 for connection of a negative high voltage to the cathode 20. Invar or other alloys may also be used if a matched coefficient of expansion is needed. Other support members can be provided, if desired, in order to stabilize the position of cathode 20 and other parts, to be described, within the casing 25.

Also secured within the enclosure 25 is an anode 50, sometimes termed a target, wherein the anode 50 is coextensive with the area of the cathode 20 and has a flat surface which is generally parallel to the facing surface of cathode 20. Anode 50 can be a foil, or thin film of any high atomic number material, typically tungsten, molybdenum, iridium or the like. Anode 50 can have a thickness of less than 1 mm and is preferably made of tungsten. Anode 50 is typically spaced from cathode 20 by about 3 inches.

Preferably, the anode 50 is a flat, uniformly thick film. This can be obtained by RF sputtering of a tungsten film on an optically smooth interior surface of the aluminum window. Thus, the aluminum window may be made of cast-tool and jig plate grade. Such material is available, for example, from Alcoa Corporation and its opposite surfaces are ground flat and parallel, and the plate is thereafter stress relieved. The plate may have a thickness less than about two millimeters. Its interior surface is machined, for example, using conventional single point diamond machining to form as flat as possible a surface, consistent with cost considerations. Preferably, the aluminum surface should be flat to less than $\frac{1}{4}$ wave. The surface is then degreased and cleaned as necessary, using conventional optical cleaning techniques, and the window is placed in a conventional RF sputtering apparatus. A thin film of tungsten, or other high Z material, is then sputtered onto the plate to a thickness less than about one micron. The window should be rotated during the sputtering operation to improve the coating thickness uniformity. The resulting film will then have optical quality flatness and uniformity.

A collimated lead pinhole filled collimating ring 51 is also provided outside of the tube 25 to obtain, to insure, collimation of the output beam of X-rays. X-ray photons generated by anode 50 are schematically illustrated by wavy lines with arrows coming out of the window 27 in FIG. 3. Note that these X-rays are produced by a generally uniform electron flux extending from the cathode 20 to the anode 50 during the tube operation. The pinhole collimator 51 has certain drawbacks in that the atoms of the collimator act as additional scattering centers, then reducing efficiency of X-ray flux production and sharpness of the X-ray image.

The preferred beam limiting collimator can consist of 2 pairs of "tambour" type closures, each consisting of parallel, linked, overlapping lead slats which envelope around the tube. Each pair closes orthogonally to the other so that a rectangular area of any shape can be exposed through the partly opened pairs of tambours. The pairs are disposed in spaced parallel planes each parallel to the X-ray window of the tube, and are separately operable. By suitably shaping the leading edge of the tambours, shapes other than rectangular openings can be produced. A specific arrangement of this type is later described in connection with FIGS. 12 to 15.

The leading edge of the tambours should also carry light source means to outline their relative positions on the body of the patient, so that the X-ray beam area is well defined to the operator.

Figure 6:
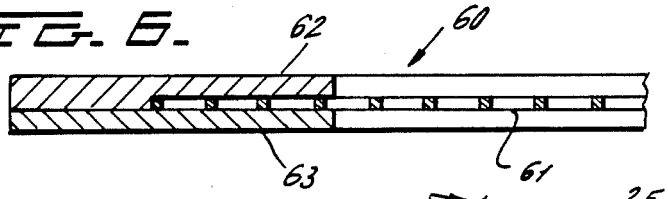
FIG. 6 is an enlarged view showing a detail of the grid structure of the tube of FIG. 1.

In accordance with the present invention, a control grid 60 is interposed between the anode 50 and cathode 20. Grid 60 may be spaced from the anode 50 by a distance sufficient to withstand the high voltage between the two. Grid 60 is preferably formed of a high purity nickel screen having any desired mesh. By high purity is meant 99.999% pure nickel. As shown in FIG. 6, the screen section 61 may be relatively incapable of being self-supporting and can be supported between rectangular or other shaped frame sections 62 and 63 (FIG. 6) which can be spot welded together or otherwise secured to hold the screen 61 in rigid position. Such screens are known and are used in prior art hydrogen thyratrons. The screen 60 is suitably supported within the tube 25 and an electric output lead 70 is taken from the screen 50 through a feed-through insulator 71 to make the grid or screen 60 externally available for electrical connection.

The interior of envelope 25 may be filled with hydrogen gas or argon at about $10^{-4}$ torr. Other pressures, including a positive pressure, could be used. Thus, the tube is a gas tube, as schematically illustrated in FIG. 3 by the conventional dot 75. A vacuum pump connection 76 may be provided which is connected to a vacuum pump 77 and regulator 78 to ensure the maintenance of a constant gas pressure. A suitable hydrogen source or other source can be contained within the tube in conventional fashion. Thus, hydrogen source **77*a* can be connected to inlet 76*a* through valve 78*a***.

In operating the tube of FIG. 3, a pulse of 1 nanosecond to 1 microsecond duration can be applied to terminal 70, which may be a pulse to ground from a voltage of $-25$ to $-150$ $KV_{peak}$ kilovolts, while approximately the same negative high voltage is applied to line 42. Obviously, any desired range of voltages could be used so long as it is sufficiently high (greater than almost 20 KVpeak) to generate the necessary photons.

In operation, application of a grid potential will immediately cause the tube to fire, thus producing an electron flux which impinges upon the anode or target 50 thereby to produce an output X-ray flux having constant bremstrahlung content for a predetermined period, for example less than about 1 microsecond, as determined by the application of the tube.

The operation of the tube of FIG. 3 is such that no single hot spot is formed on the anode 50. The anode 50 is therefore a long lived reliable structure and is uniformly illuminated by a relatively low current density. Consequently, there is little or no pitting of the anode 50 and little or no plating of the anode material on the interior of the tube. Obviously, cathode/filament problems are non-existent. Significantly, the tube is controlled by the grid 60 in the manner of a known hydrogen thyratron so that the KVpeak of the tube is constant over its operating range, thereby leading to a constant bremstrahlung content of the photons emitted from the anode 50.

In accordance with a further feature of the invention, a novel collimation means is provided to ensure collimation of the output X-ray flux without a pinhole collimator 29 of FIG. 3 which degrades the sharpness of the X-ray image. Note that the following collimation technique has important utility, even in the absence of grid 60. This feature of the invention employs means to polarize the electron beam which is applied to the anode 50 and which ensures that all electrons reach the surface of anode 50 in phase and moving in the same direction. Various magnetic and electrostatic control systems can be employed to polarize the electron beam, including axial and quadrapole magnets.

Figure 3A:
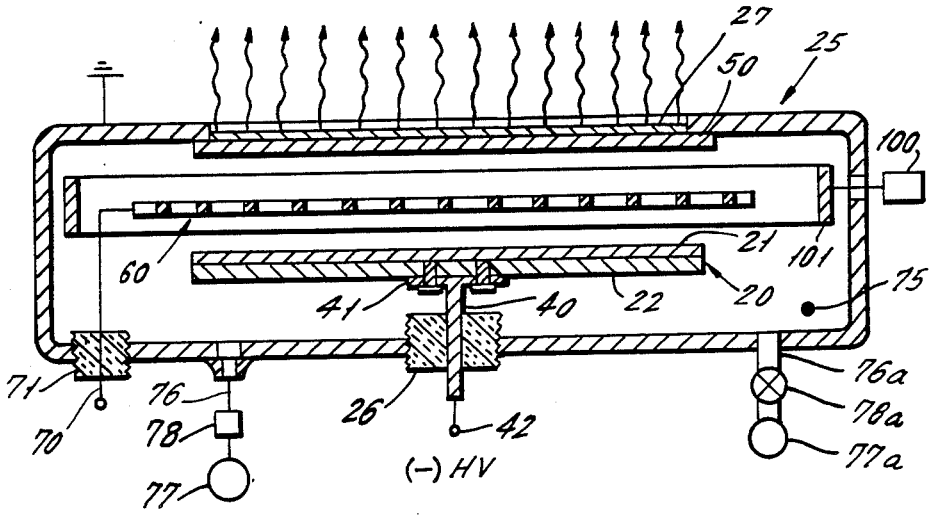
FIG. 3*a* is a diagram similar to FIG. 3 with a different type of collimator.

FIG. 3*a*, which is like FIG. 3 but without the pinhole collimator 29, schematically illustrates a high frequency electrostatic field generator 100 connected to conductive ring 101 which is suitably supported within the tube to impart a high frequency lateral oscillation to the electrons passing grid 60 and before they impinge on anode 50. Ring segments or other configurations can be used. Generator 100 would produce in excess of 1 KVpeak and a frequency of 10 megahertz to 100 gigahertz, depending on the final pulse width which is desired.

Figure 3B:
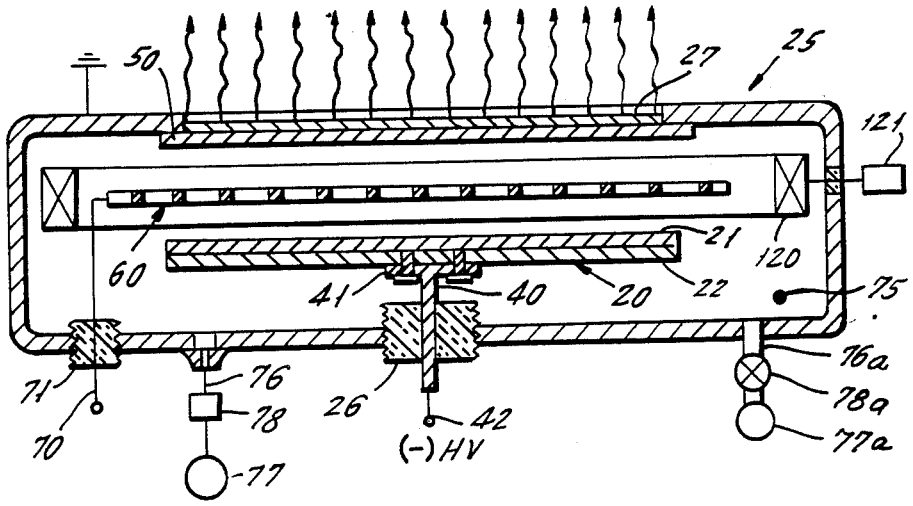
FIG. 3*b* is a diagram similar to FIGS. 3 and 3*a* with a still different type of collimator.

FIG. 3*b* is similar to FIGS. 3 and 3*a*, except the collimation function is performed by coil 120 connected to a high frequency source 121 which operates in the 10 megahertz to 100 gigahertz range. Thus, coil 120 produces a magnetic field which is perpendicular to the path taken by the electrons from cathode to anode. The frequency of source 121 must be high enough relative to the electron transit time that the electrons will be subject to a larger number of polarizing cycles to increase the electron coherency or polarization which tends to polarize the electrons propagating from cathode 22 to anode 50, such that all electrons strike anode 50 with angular or direction coherence. This ensures that the output X-ray flux will be collimated. Note that the pulses of output electrons are so short that the phenomena can be considered wave phenomena as well as particle or beam phenomena.

The polarizing magnetic field of FIG. 3*b* can also be a d-c field which is parallel to the axis of the tube and parallel to the electron path.

The basic tube configuration of FIGS. 3, 3*a* and 3*b* can have any desired shape or elongation. For example, the cathode 20 and anode 50 and grid 60 can be coextensive and of rectangular configuration for use as a chest X-ray source for exposing plates having dimensions of 16 inches×16 inches. Alternatively, the anode 50 and cathode 20 can conform to the shape of a desired application. For example, if the X-ray tube of the invention is to be employed as a source for a CAT scan application, the source is preferably a thin elongated tube which is arcuately curved to fit around the body could also be flat segments of a patient. Those segments could also be straight. Thus, tube envelope 25 can have the configuration shown in FIG. 7 as seen from a side elevation. In this elevation, the length of the tube can be from 6–10 inches and its width, shown in FIG. 8, can be about 10 millimeters.

Figure 9:
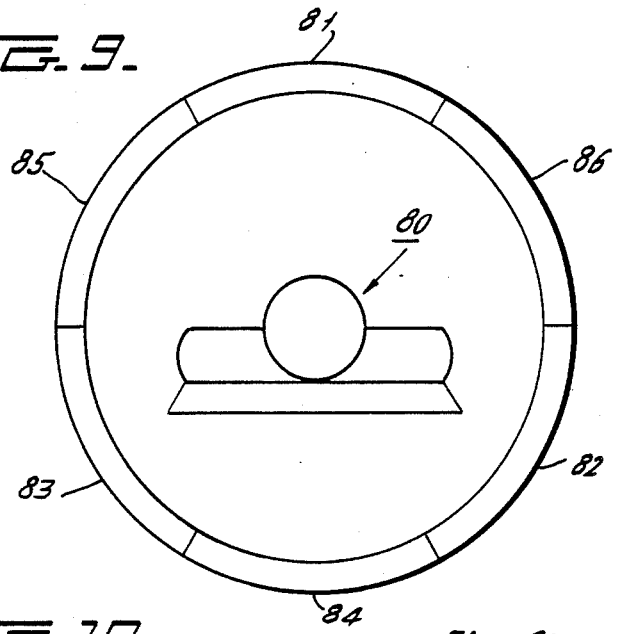
FIG. 9 shows an application of tubes employing segments such as those of FIGS. 5 and 6 for a CAT scan type of application.

The arcuate section shown in FIGS. 7 and 8 can be assembled with other identical sections in arrays such as those shown in FIG. 9 to form an entire enclosure about a patient 80 disposed within the ring. Thus, in FIG. 9, the ring consists of three source tubes 81, 82 and 83 which are disposed diametrically opposite to respective detectors 84, 85 and 86. Any desired number of tubes could have been used.

The radiation from the sources 81, 82 and 83 in FIG. 9 will be relatively parallel beams extending through a vertical slice in the patient and can be processed using known CAT scan techniques and algorithms. Suitable electrical controls can be employed, for example to step the pulsing of the sources 81, 82 and 83, in circular fashion in order to produce the necessary data for reassembling the image which is desired.

Other geometric arrangements are possible. For example, the arcuate or flat segments 85, 81 and 86 could be source tubes of the types shown in FIGS. 7 and 8 while the segments 82, 84 and 83 could be their respective detectors.

Figure 10:
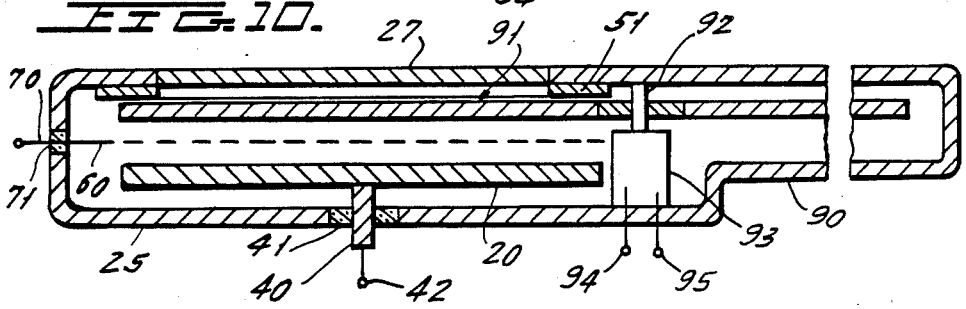
FIG. 10 is a cross-sectional view of a second embodiment of the novel tube of the invention which makes it possible to replace the anode of the tube by any one of a plurality of different anode elements.
Figure 11:
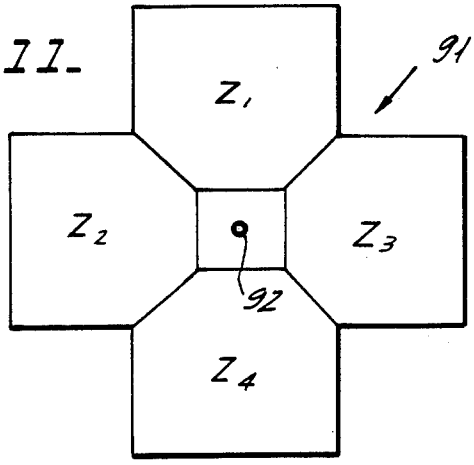
FIG. 11 is a top view of the anode which can be employed in the embodiment of FIG. 9.
Figure 12:
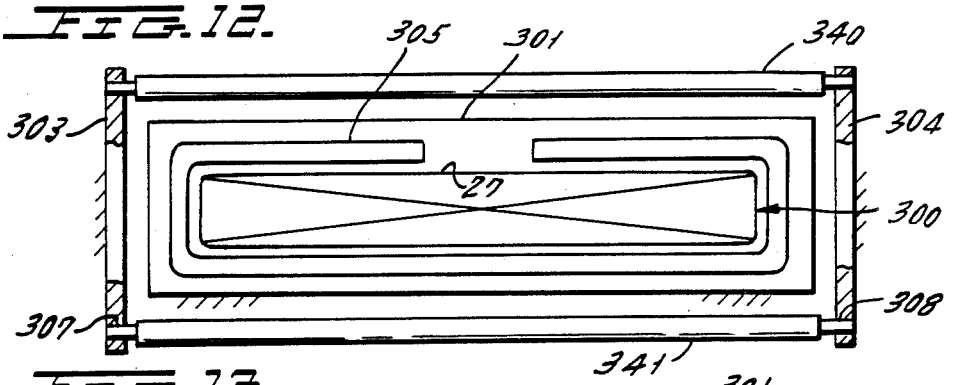
FIG. 12 shows a small tambour arrangement of lead slats to form a controlled beam limiting window area.

FIGS. 10 and 11 show a further embodiment of the invention which enables controlled replacement of the anode material in order to produce an X-ray tube which has controlled X-ray outputs for producing different preselected X-ray spectra. There is first schematically illustrated in FIG. 10 a novel X-ray tube which has many of the elements of the tubes of FIGS. 3, 3*a* or 3*b* which have similar identifying numerals in FIG. 10. In FIG. 10, however, the envelope 25 is laterally elongated to contain a section 90 and the anode 50 of FIG. 3 has been replaced by a paddle type configuration 91 (FIG. 11) which is rotatably mounted within the casing 25–90 on its central axis 92. A stepping motor 93 is provided having schematically shown terminals 94 and 95 extending externally of casing 25–90 and rotates the paddle 91 between four possible positions to bring any of the anode sections Z1, Z2, Z3 or Z4 into opposing relationship with the rectangularly shaped cathode 20. The stepper 93 could also be mounted external to the vacuum enclosure 25 with an appropriate rotary feedthrough (not shown). Each of these sections has a different atomic number so that, upon impingement of electrons from the cathode 20, the sections will produce an X-ray outputs containing a spectral content for different diagnostic or other applications. Thus, a patient can receive X-rays of different spectral content without need for moving the patient or replacing the apparatus employed. Alternatively, the same basic equipment can be used for performing different procedures requiring different anode materials. Similarly, the novel arrangement of FIGS. 10 and 11 make it unnecessary to keep in stock numerous types of X-ray tubes having different spectral outputs and reduces the space and inventory needed for the X-ray facility.

A rotating filter wheel of conventional filters may also be disposed atop paddle member 91 so that a filter of appropriate characteristics can be positioned between the anodes of member 91 and the window 27. This filter can be rotated coaxially with paddle 91 and/or can be operated by a separate motor coaxially mounted with motor 93 within housing 25.

Figure 13:
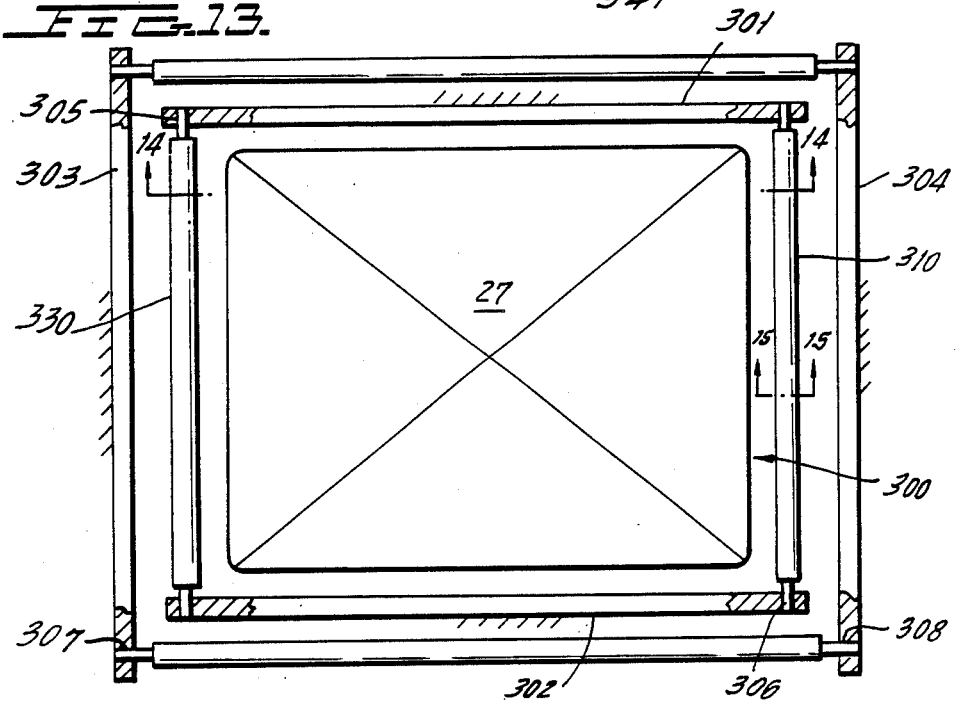
FIG. 13 is a view of FIG. 12, seen from the top.
Figure 14:
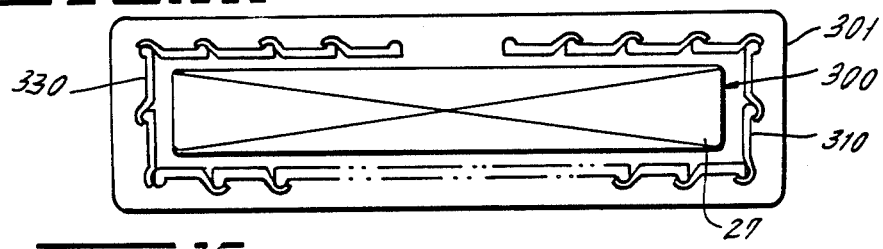
FIG. 14 is a cross-section of FIG. 13 taken across section lines 14—14 in FIG. 13.
Figure 15:
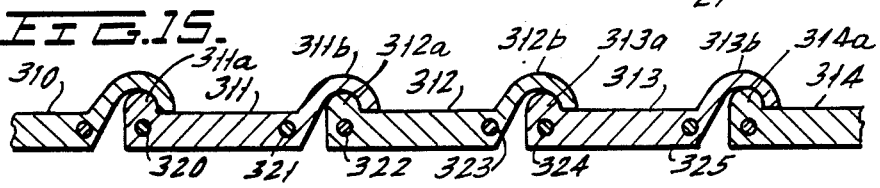
FIG. 15 shows a chain of lead slats as seen across section line 15—15 in FIG. 13.

Referring next to FIGS. 12 to 15, there is shown a novel tambour for defining any desired rectangular shape aperture around the window 27 of the extended area X-ray source tube of FIGS. 3, 3*a* and 3*b*. The tube is shown generally by numeral 300. Two pairs of orthogonally arranged steel guide plates 301, 302 and 303, 304 are suitably supported relative to tube 300. Each of plates 301 to 304 has an elongated slot, shown as slot 305 in plate 301 (FIG. 12), and similarly shaped slots 306, 307 and 308 in plates 302, 303 and 304, respectively. A plurality of parallel lead slats, such as lead slats 310 to 314 in FIG. 15, are provided with steel pins at their opposite ends, shown as steel pins 320, 321 for slat 311; steel pins 322, 323 for slat 312; and steel pins 324, 325 for slat 313. These pins are adapted to be slidingly received by the slats 305, 306, 307 and 308. Preferably, the pins will have small bearings (not shown) to reduce wear. As shown in FIG. 13, two respective chains of slats, including slats 310 and 330, which is identical to slat 310, are slidingly captured between slats 305 and 306. Similarly, two chains of slats, including slats 340 and 341 (FIG. 12) are slidingly captured between slats 307 and 308. These later chains of slats are disposed orthogonally to and exterior of the two chains of slats, including slats 310 and 330.

The chains of slats are formed in any desired way. Thus, as shown in FIG. 15, the ends of each slat may have enlarged knobs 311*a* through 314*a* for slats 311 to 314, respectively. Each slat also has a hook member 311*b*, 312*b*, 313*b* and 314*b* for slats 311 to 314 which receive the knobs of the adjacent slat. Thus, a flexible chain of slats is formed.

Each of the chains of slats has a length to enable total masking of window 27, or total opening of the window area, and the formation of any rectangular shape opening.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A wide area cold cathode X-ray source comprising:

a cathode electrode having a wide area surface which emits electrons over substantially the full area of said surface in the presence of a sufficiently high electric field;

an anode electrode having a wide area surface which is spaced from and is coextensive with said cathode wide area surface;

a control grid electrode which acts as a gate disposed between and substantially coextensive with said wide area surfaces of said anode and cathode electrodes;

an envelope for enclosing said anode, cathode and grid electrodes; said envelope being filled with gas; said envelope having a window region transparent to X-rays disposed adjacent said anode; and electrical connection means for making electrical connection to said anode and cathode electrodes and to said grid electrode, such that a sufficiently high voltage can be applied for up to about 1 microsecond between said grid and cathode to cause electron emission from said cathode wide area surface to said anode at sufficient energy to produce an X-ray flux from said anode, which flux flows through said window region of said envelope, and such that the voltage $KV_{peak}$ between said anode and said cathode is substantially constant and the bremstrahlung spectrum of X-rays emitted from said anode is substantially constant.

2. The X-ray source of claim 1, wherein said cathode comprises a graphite felt surface defining said wide area surface of said cathode electrode.

3. The X-ray source of claim 1, wherein said cathode comprises a graphite substrate and a graphite felt layer adhered to said substrate and forming said wide area surface of said cathode electrode.

4. The X-ray source of claim 1 which further includes a plurality of coplanar anodes disposed within said envelope; said plurality of anodes being rotatable about an axis disposed perpendicular to the plane of said anodes; each of said anodes being rotatable to a position in which it is substantially coextensive with said cathode.

5. The X-ray source of claim 4, wherein each of said coplanar anodes has a different atomic number from that of the others.

6. The X-ray source of claim 1 which includes a low pressure gas within said envelope.

7. The X-ray source of claim 1, wherein said cathode electrode is substantially square in shape and flat and has a length and width of about 16 inches each.

8. The X-ray source of claim 1, wherein said cathode, anode, grid electrodes and envelope are coextensively elongated over an arcuate path and define sections of a cylinder.

9. A cold cathode triode gas tube having an X-ray flux output produced by impingement of electrons on the anode within said tube for up to about 1 microsecond; said X-ray flux output having a constant bremstrahlung spectral distribution.

10. The process of producing a large area flux of substantially collimated X-rays comprising the ignition of a uniform arc current from a wide area cathode within a gas filled envelope, and causing said arc current to flow through an arc-igniting grid which is spaced between said cathode and a target anode and which acts as a gate, and maintaining said arc current flow for up to about 1 microsecond, such that the voltage $KV_{peak}$ between anode and cathode is substantially constant and the bremstrahlung spectrum of X-rays emitted from said anode is substantially constant.

11. The X-ray source of claim 5 which further includes a plurality of coplanar filters disposed within said envelope and disposed between said anodes and said envelope and rotatable to positions at which individual ones of said plurality of filters are disposed above said cathode wide area surface.

12. The X-ray source of claim 1 which further includes a collimator means disposed externally of said source and consisting of first and second orthogonally disposed collimator curtains which are disposed in different respective planes and close more or less to define a desired aperture shape to intercept said X-ray flux flowing out of said envelope.

13. The X-ray source of claim 12, wherein said curtains each consist of parallel, thin, lead slats which are pivotally linked together in the manner of a tambour.

14. The X-ray source of claim 13, wherein each of said curtains wrap around four lateral sides of said tube.

15. The process of producing a wide area flux of substantially collimated X-rays from a wide area anode, comprising steps of igniting a uniform arc current from an extended area cathode within a low pressure gas filled envelope for up to about 1 microsecond and polarizing said uniform arc current, such that substantially all of the electrons of said arc current impinge on said anode at substantially the same angle.

16. A large area cold cathode X-ray source comprising:

a cathode electrode having a wide area surface which emits electrons over substantially the full area of said surface in the presence of a sufficiently high electric field;

an anode electrode having a wide area surface which is spaced from and is coextensive with said cathode wide area surface;

a control grid electrode which acts as a gate between and substantially coextensive with said wide area surfaces of said anode and cathode electrodes; said electrical connection means further connected to said grid electrode;

an envelope for enclosing said anode, cathode, and grid electrodes; said envelope being filled with gas at low pressure; said envelope having a window region transparent to X-rays; said window disposed adjacent said anode;

electrical connection means for making electrical connection to said anode, cathode and grid electrodes, such that a sufficiently high voltage can be applied for up to about 1 microsecond between said grid and cathode to cause electron emission from said cathode wide area surface which is accelerated toward said anode to a sufficient energy to produce an X-ray flux from said anode, which flux flows through said window region of said envelope, and such that the voltage $KV_{peak}$ between said anode and said cathode is substantially constant and the bremstrahlung spectrum of X-rays emitted from said anode is substantailly constant; and collimator means disposed adjacent said anode for collimating said X-ray flux which flows out through said window.

17. The device of claim 16, wherein said collimating means comprises a pinhole collimator disposed across said window region.

18. The device of claim 16, wherein said collimator means comprises means for producing directional coherence of the electrons which reach said anode electrode from said cathode electrode such that said electrons impinge upon said anode electrode at the same angle, such that the X-ray flux produced by said electrons is collimated.

* * * * *